United States Patent [19]

Lehmacher

[11] 4,342,564

[45] Aug. 3, 1982

[54] APPARATUS FOR THE STACKING AND CONNECTION OF SYNTHETIC-RESIN FOIL BAGS

[76] Inventor: Hans Lehmacher, Auf dem Hummerich, 5216 Niederkassel-Mondorf, Fed. Rep. of Germany

[21] Appl. No.: 159,397

[22] Filed: Jun. 13, 1980

[30] Foreign Application Priority Data

Jun. 15, 1979 [DE] Fed. Rep. of Germany ..... 2924106

[51] Int. Cl.[3] ..... B31B 23/14

[52] U.S. Cl. ..... 493/195; 156/563; 493/204

[58] Field of Search ..... 493/204, 203, 195, 194, 493/193, 198, 209, 226, 221; 156/563

[56] References Cited

U.S. PATENT DOCUMENTS

| | | | |
|---|---|---|---|
| 2,973,797 | 3/1961 | Sylvester | 156/563 X |
| 3,729,361 | 4/1973 | Westlake, Jr. | 493/197 X |
| 3,966,524 | 6/1976 | Lehmacher | 493/204 X |
| 4,128,049 | 12/1978 | Lehmacher | 493/204 X |
| 4,181,069 | 1/1980 | Porter | 493/204 X |
| 4,270,908 | 6/1981 | Lehmacher | 493/204 |

*Primary Examiner*—James F. Coan
*Attorney, Agent, or Firm*—Karl F. Ross

[57] ABSTRACT

A flattened tube of synthetic resin is heat-sealed along a leading edge and a multiplicity of perforations are punched along an arcuate line spaced from and convex towards the sealed tube end. The tube is subsequently conveyed to a stacking station where a fusing area defined by the perforations is thermally bonded to a similar area of an underlying bag. The tube is transversely cut along a base line of the fusing area. In an apparatus implementing the method at least one perforator is shiftably mounted on a carriage upstream of the stacking station for positional adjustment parallel to and perpendicular to the direction of tube transport. A needle bar at the stacking station has several threaded bores for receiving one or more heating plugs energizing respective mandrels which traverse a lower and an upper clamping bar during an upward shift of the needle bar to pierce the plastic tube at respective fusing areas. Each bore in the needle bar is flanked by a pair of parallel needles. Also disposed at the stacking station are a pair of welding bars for forming the heat-sealed transverse seam in each bag, a cutting blade for successively severing bags from the tube and further clamping bars.

6 Claims, 9 Drawing Figures

APPARATUS FOR THE STACKING AND CONNECTION OF SYNTHETIC-RESIN FOIL BAGS

CROSS-REFERENCE TO RELATED APPLICATION

The present application is related to my copending U.S. patent application Ser. No. 036,085 filed May 4, 1979 now U.S. Pat. No. 4,270,908.

FIELD OF THE INVENTION

My present invention relates to a method of and an apparatus for stacking and interconnecting synthetic-resin foil or sheet bags, hereinafter referred to as plastic bags and, more particularly, to an apparatus for producing stacks, pads or blocks of interconnected plastic bags which can be separated, one at a time, from the block or stack in use.

BACKGROUND OF THE INVENTION

In the manufacture of synthetic-resin foil or sheet bags (plastic) bags, the synthetic-resin material is usually blown to produce a foil or sheet which is flattened and sealed along various edges to produce individual bags which can be separated from the continuous extruded material and packaged or assembled for distribution or use.

One of the principal forms of distribution is an assembly of such bags in a stack in which the bags are generally interconnected along one edge, i.e. in a pad or a block from which individual bags may be removed for use, as proposed in German patent document (Auslegeschrift) DT-AS No. 2,141,045.7. To interconnect the bags by means of heated welding mandrels or pins, as described in U.S. Pat. No. 3,021,947, has required the formation of a fusing or fastening strip along one end of each bag, a bag being removed from a stack by tearing along a line of perforations defining the fusing strip. Such strips represent a waste of synthetic resin, which waste is particularly costly in times of scarcity of raw materials. Scarcity induces the production of thinner-walled plastic bags which have a relatively small slope or inclination when stacked.

In German Open Application (Offenlegungsschrift) DE-OS No. 2,418,233.0-27, a proposal for simplifying the interlocking or connection of bags includes a machine having clamping bars, a separate needle bar and another bar for carrying the heating elements. The bags are joined to one another via respective welding strips extending the breadth of the bags and separable therefrom along a line of perforations.

It has been proposed to connect the bags at fusing areas or sections located at the corners or in the middle of an edge of the plastic bags, the connection being implemented by means of the afore-mentioned heating or welding pins. In known devices for thermally bonding the bags at such localized fusing areas, the bags are initially placed in stacks and then bonded by the welding pins and perforated by punches. Owing to the thinness of the plastic bags, another method for forming the bag pads has not been conceived until now. For this reason the description in U.S. Pat. No. 3,021,947 is sketchy and includes no apparatus utilizing the proposed welding pins.

OBJECTS OF THE INVENTION

An object of my present invention is to provide an improved apparatus for producing pads of interconnected plastic bags.

Another object of my present invention is to provide a relatively simple and reliable apparatus for carrying out this apparatus.

Yet another object of my present invention is to provide such an apparatus which is readily adaptable to forming stacks of bags of different widths and lengths.

SUMMARY OF THE INVENTION

The apparatus for producing a stack of interconnected synthetic-resin foil bags from a flattened plastic tube having a substantially uniform width, according to my present invention, effects the steps of heat-sealing a leading end of the tube to form a transverse seam constituting a bottom end of a bag and punching a multiplicity of perforations in the tube at predetermined distances from the transverse seam and from longitudinal sides of the tube to define the perimeter of a predetermined closed fusing area having at least one rectilinear side extending parallel to the seam for a distance shorter than the tube width. Preferably, the perforations are punched along an arcuate line convex towards the bag seam, the rectilinear fusing-area side being defined by the two end points of the line of perforations. Subsequently to the seam formation and the perforation the tube is longitudinally conveyed to a fixed stacking station and a terminal portion of the tube, defined by the seam at one end and the rectilinear fusing-area base line at the other end, is placed on a stack of previously formed plastic bags. The fusing area is aligned with similarly shaped splicing areas of the plastic bags already in the stack. The fusing area is then thermally bonded to a splicing area of an underlying plastic bag and the tube is severed parallel to the seam and along the fusing-area base line.

An apparatus for carrying out this method comprises a punch juxtaposed to a path of transport of the tube for forming the perforations, a blade at a stacking station for transversely cutting or severing the tube along the fusing-area base line, a welder preferably in the form of a heating bar for heat-sealing the tube to form the transverse seam, a clamp juxtaposed to the blade for holding the tube during a cutting stroke of the blade, a conveyor for transporting the tube along the transport path to the stacking station and a needle bar extending transversely to the transport path at the stacking station, the needle bar including a heatable mandrel or pin extending perpendicularly to the tube and to its direction of motion for thermally bonding the splicing or fusing areas of adjacent bags in the stack. The needle bar has at least two needles disposed parallel to the mandrel and substantially in a line therewith extending transversely to the tube, i.e. parallel to the plane of the tube and perpendicular to the longitudinal sides thereof.

According to another feature of my present invention, the needle bar is provided with at least one threaded bore for the reception of a heater plug for thermally energizing the mandrel. Preferably, a plurality of threaded bores are provided, whereby the position of the plug and the mandrel may be adjusted transversely to the tube to enable a varying disposition of the fusing or splicing area. Each heater-plug bore is advantageously flanked by a respective pair of needles. In addition, several heater plugs and mandrels may be mounted on the needle bar for thermally bonding each bag to the stack at a plurality of splicing areas or for simultaneously connecting several bags to respective stacks.

According to another feature of my present invention, the conveyor includes a pair of rollers upstream of the stacking station, the punch being located along the transport path upstream of the rollers. These rollers facilitate the feeding of thin-walled plastic tubes by inhibiting the tearing thereof, while the punch (or punches in the case of more than one fusing area per bag or more than one bag) may be shiftably mounted on a carriage for relatively easy and simple position adjustment transverse to the tube or parallel to the direction of transport.

Pursuant to further features of my present invention, the clamp includes an upper and lower clamping bar extending parallel to one another and perpendicular to the tube-transport direction, the needle bar being disposed below the lower clamping bar. The clamps are provided with apertures aligned with the needles and the mandrels or plug bores, whereby the mandrels and the needles traverse the lower clamping bar and at least a portion of the upper clamping bar to pierce the tube for aligning and thermally bonding the same. The welder includes a pair of vertically reciprocatable heating or welding bars and the clamp includes an additional upper and lower clamping bar vertically reciprocatable in synchronism with the blade and with the heating bars.

A pad-forming apparatus according to my present invention makes an efficient use of space and of structural elements and facilitates the stacking of bags of especially thin walls.

BRIEF DESCRIPTION OF THE DRAWING

These and other features and advantages of my present invention will now be described in detail, reference being made to the accompanying drawing in which.

SPECIFIC DESCRIPTION

Figure 1:
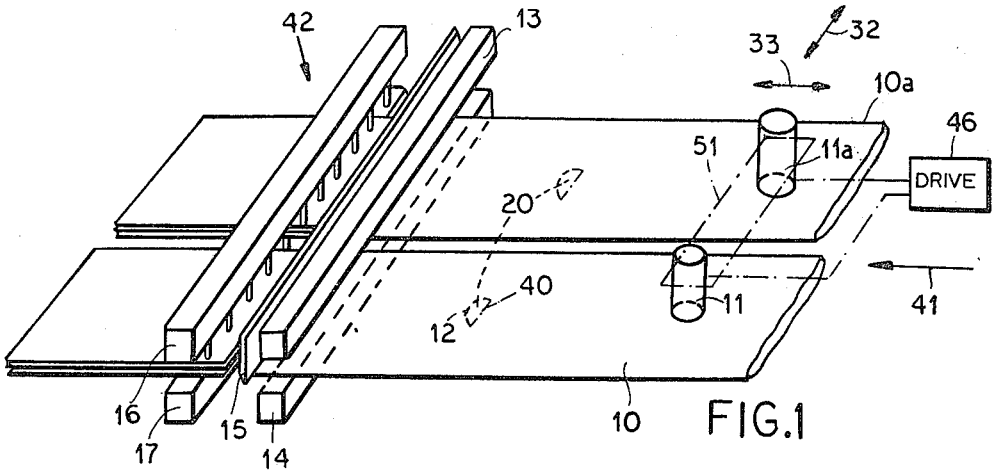
FIG. 1 is a diagrammatic perspective view of a bag-cutting, -stacking and -connecting assembly according to my present invention, showing a cutting blade, a needle bar and a clamping bar at a stacking station.

As schematically illustrated in FIG. 1, an apparatus for forming a stack 44 (see FIGS. 2A–2C) of interconnected synthetic-resin bags 45 from a flattened plastic tube 10 conveyed from an extruding and blowing machine (not shown) comprises, according to my present invention, one or more perforators 11, 11*a* for punching perforations 12 in tube 10 to define the perimeters of respective splicing areas 20. These perimeters each include at least one rectilinear side 40 extending substantially transverse to tube 10 and to a direction of transport 41 thereof. Downstream of perforators 11, 11*a* is a stacking station 42 at which are located a pair of heating or welding bars 13, 14 for heat sealing tube 10 to form a transverse seam 43 (see FIGS. 2A–2C) defining the bottom of a respective bag, a cutting edge or blade 15 for slicing tube 10 parallel to seam 43 and a needle bar 17 coacting with a clamping bar 16 to fix successively arriving sealed tube portions or bags 45 in a stack and to interconnect these bags via thermal bonding.

Figure 2A:
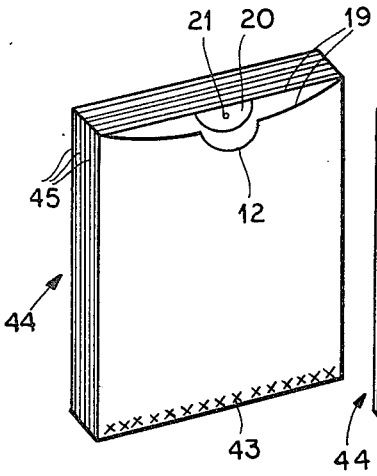
FIGS. 2A–2C are perspective views of respective bag pads produced by the assembly of FIG. 1.
Figure 2B:
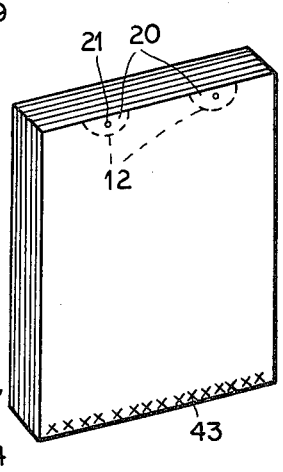
Figure 2C:
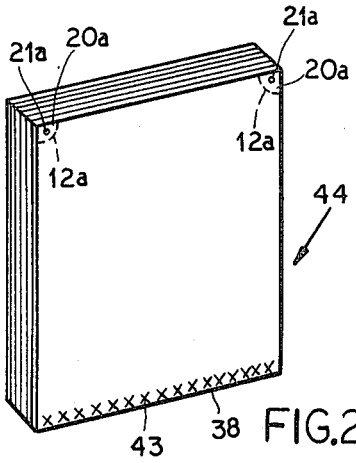

As shown in FIGS. 2A–2C, the dispositions and shapes of the splicing or bonding areas 20 defined by perforations 12 may be varied in accordance with particular requirements. In general a semicircular or half-moon shape is preferable (FIGS. 2A–2B), although rectangular shapes (see FIG. 3) may also be used. The location of a single splicing area 20 is in the middle of the tube 10 or of the respective plastic bag 45; while two semicircular splicing areas 20 (FIG. 2B) are preferably spaced from one another and from the sides of the respective bag 45. As shown in FIG. 2C, perforations 12 may be disposed along a pair of 90° circular arcs 12*a* in corners of a bag 45.

Perforators 11, 11*a* are shiftably mounted on a carriage 51 for position adjustments transverse to path 41 (arrow 32 in FIG. 1), whereby the locations of splicing areas 20 relative to longitudinal sides of tube 10 are varied. Perforations 12 are advantageously grouped in arcuate lines convex in the direction 41 of tube transport. In this case, splicing-area side 40 is defined by an imaginary line segment extending between opposite ends of the arc of perforations. As heretofore described, blade 15 cuts across tube 10 in a line 19 (FIG. 2A) coniciding with side 40 and defining the top edge of the respective bag 45; omitting the perforations along side 40 provides for a greater margin or error in the location of slice line 19 with respect to arc 12.

Figure 3:
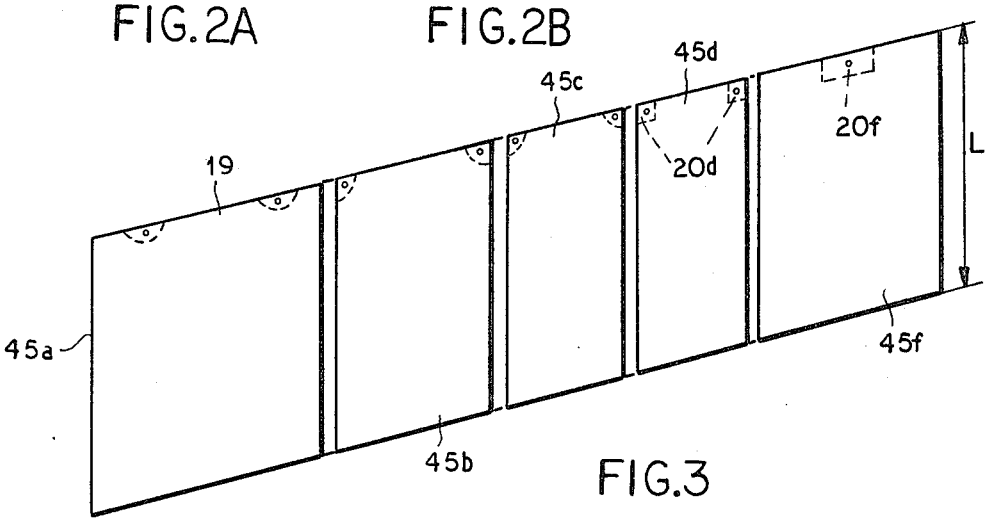
FIG. 3 is a diagram showing bags of various dimensions and bonding areas, stackable by the assembly of FIG. 1.

As indicated in FIGS. 1 and 3, several stacks of pads 44 may be produced simultaneously by an apparatus according to my present invention. A plurality of tubes 10*a*, 10*b*. . . may be conveyed along transport path 41 to stacking station 42 where the respective tubes are cut into respective sets of bags 45*a*, 45*b*. . . having a common length L determined by transport speed and a reciprocation period of blade 15. Bags 45*d* and 45*f* in FIG. 3 illustrate rectilinear splicing of fusing areas 20*d*, 20*f*.

At the stacking station 42 heating elements 30 (see FIG. 4) on needle bar 17 form thermal bonds or spot welds 21, 21*a* (FIGS. 2A–2C) at fusing areas 20, 20*a* which interconnect or lock bags 45 into stacks or pads 44. The number of such heating elements on needle bar 17 thus corresponds to the number of perforators 11, 11*a* disposed upstream of the stacking station.

Figure 4:
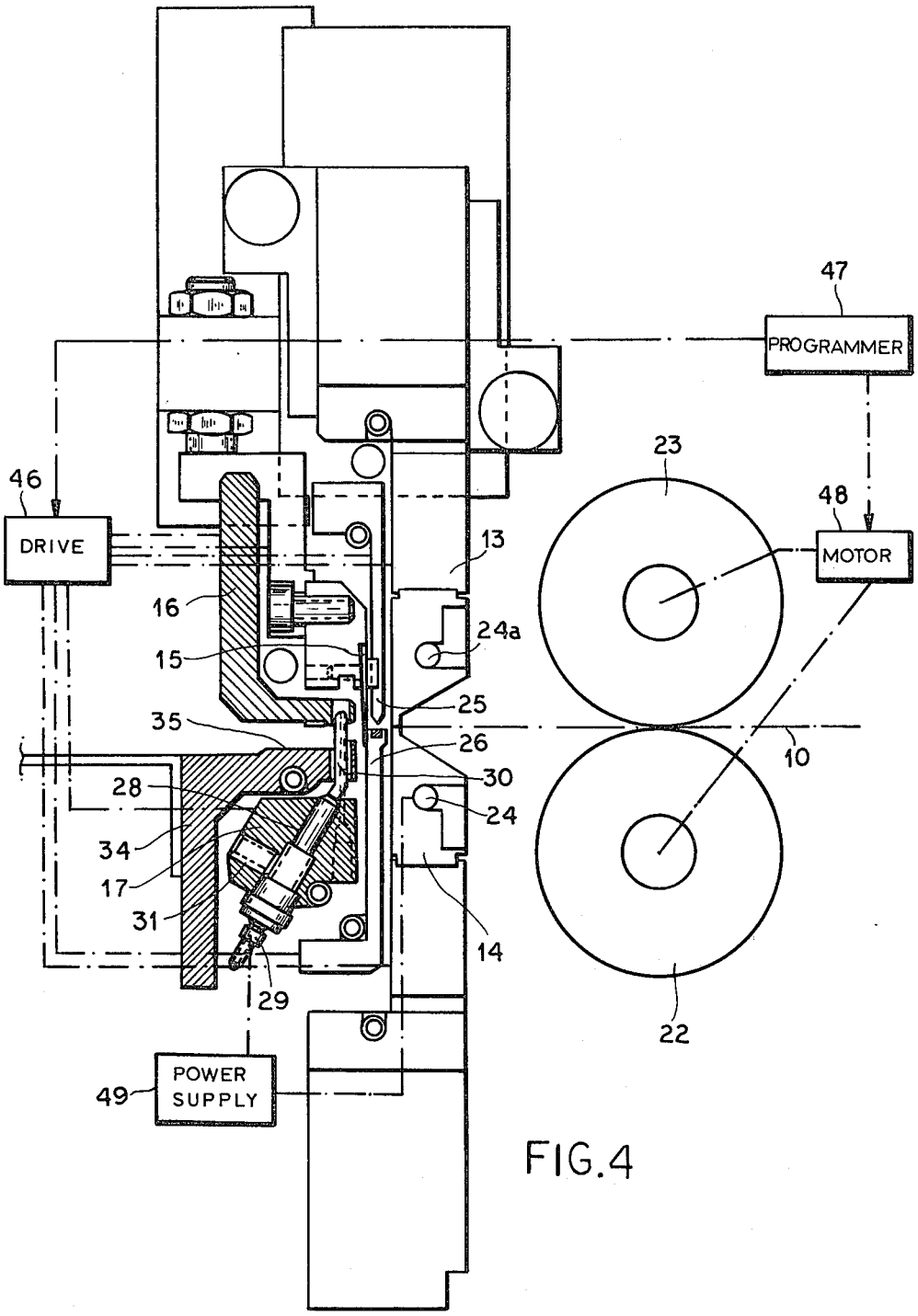
FIG. 4 is a partially schematic and partially cross-sectional side view of part of the assembly of FIG. 1, showing an upper clamping bar, a lower clamping bar and the needle bar at the stacking station.

As illustrated in detail in FIG. 4, a pad-producing assembly according to my present invention includes a pair of rollers 22, 23 upstream of the stacking station 42 for drawing tube past the perforators 11, 11*a* and ejecting it between periodically separated heating bars 13, 14. The rollers are rotated by a motor 48 and the heating bars vertically reciprocated by a drive 46, the motor and the drive being synchronized by a programmer 47.

Bars 13, 14 are heated by respective resistive elements 24*a*, 24 connected to a source 49 of electromotive power. Juxtaposed to welding bars 13, 14 are an upper and a lower clamping bar 25, 26 vertically reciprocatable by drive 46 in response to control signals from programmer 47 for gripping tube 10 (or 10*a*, 10*b*. . . ) prior to a downward cutting stroke of blade 15. Clamps 25, 26 serve, together with bar 16 and a support table 34 coacting therewith, to place a tension stress on a tube in preparation for the cutting and to prevent the tube from being drawn from the welding bars 13, 14 upon a cutting stroke of blade 15.

Figure 6:
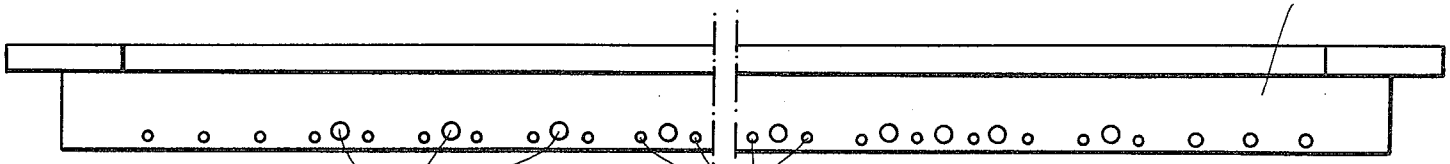
FIG. 6 is a top view of the upper clamping bar of FIG. 4.
Figure 7:
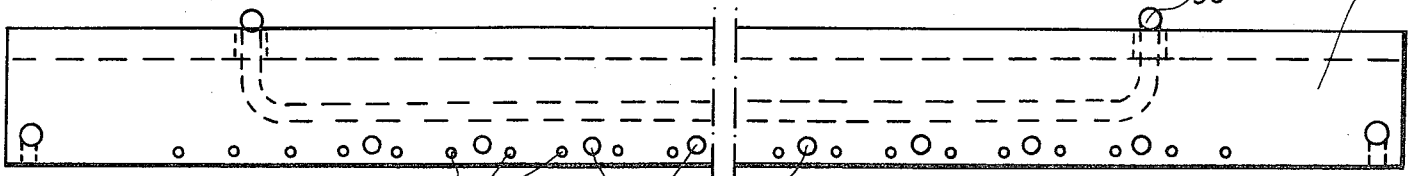
FIG. 7 is a top view of the lower clamping bar of FIG. 4.

Bar 17 is provided with a plurality of inclined bores 28 spaced from one another and threaded for receiving heating plugs 29 energized by power source 49; further threaded bores 31 extending perpendicularly to bores 28 are provided for set screws (not shown). At least one heating element 30 in the form of an angled pin, peg or mandrel is connected to a respective plug 29 and extends vertically upwardly through apertures 47 and 48 in support or clamping member 34 and clamping bar 16 (see FIGS. 6 and 7).

Clamping bar 16, needle bar 17 and blade 15, which is preferably of the sawtooth type, are connected to drive 46 for vertical reciprocation according to the programming of unit 47. Support or clamp 34 is preferably stationary but may reciprocate slightly under the control of drive 46.

Figure 5:
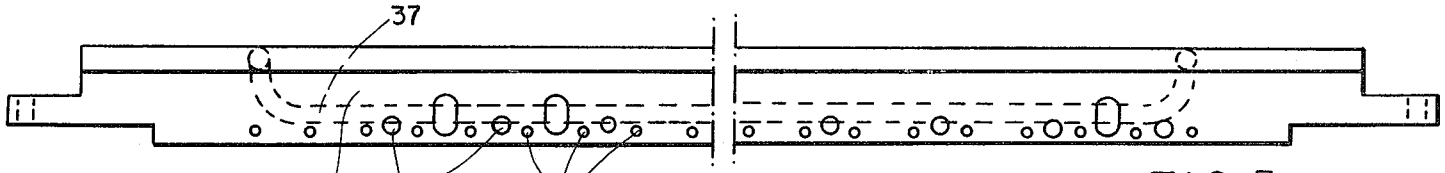
FIG. 5 is a top view of the needle bar of FIGS. 1 and 4.

As shown in FIG. 5, the spaced bores 28 for the mounting of heating plugs 29 and mandrels 30 are each flanked by a pair of needles 27 serving to grip an arriving plastic bag upon alignment thereof over a stack 44 at stacking station 42. Needles 27 prevent the enlargement of a weld hole 21 due to shifts of a bag about a respective heating mandrel 30. Clamping bar 16 is provided with openings 49 flanking apertures 47, and support 34 with openings 50 flanking apertures 48, these openings guiding pins 30 during opening and closing strokes of bars 16 and 17. Bars 17 and 34 are provided with ducts or conduits 37 and 36 for the channeling of a coolant such as water.

At the beginning of bag-severing and -stacking cycle, rollers 22, 23 are actuated by programmer 47 via motor 48 to eject a forward portion of tube 10 (or the forward portions of a multiplicity of tubes 10*a*, 10*b*. . . ) between separated welding bars 13 and 14 and clamping bars 25 and 26, under uplifted blade 15 and between the top ends of mandrel or mandrels 30 and of pins 27 and the lower side of clamping bar 16. Upon a subsequent arrest of rollers 22, 23 and the positioning of the forward or leading portion of tube 10 over a previously formed stack or pad on a table surface 35 (FIG. 4) of support 34, welders 13, 14 begin respective upward and downward strokes. Prior to the completion of these strokes, i.e. prior to the pressing of the tube between welders 13 and 14, clamping bar 16 and needle bar 17 move toward one another, whereupon tube 10 is punched by needles 27 and by heating mandrel or mandrels 30; clamping bars 25, 26 simultaneously close, whereby tube 10 is locked or fixed between needles 27 on the one side and clamps 25 and 26 on the other side. Upon the closing of these clamps, welding bars 13 and 14 complete their respective strokes and begin forming a heat-sealed transverse seam 43 in the tube. Blade 15 descends and severs the leading tube portion stacked over table 35. Drive 46 then shifts bars 13 and 14, 16 and 17, and 25 and 26 away from one another and elevates blade 15 in preparation for an ensuing bag-severing and -stacking cycle. The leading end of tube 10 has been sealed by welding bars 13, 14 to form a bottom seam for the next plastic bag in the stack.

Perforators 11, 11*a* are vertically reciprocated in synchronism with rollers 22, 23 and welding bars 13, 14 by drive 46 (FIG. 1) in response to control signals from the programmer. The perforators are longitudinally shiftable relative to the tube-transport path 41, as indicated by an arrow 33 in FIG. 1, whereby splicing-area side 40 can be adjusted to coincide with cut line 19.

I claim:

1. An apparatus for producing a stack of interconnected synthetic-resin foil bags from a flattened plastic tube having a substantially uniform width, comprising:

punch means juxtaposed to a path of transport of said tube for forming a multiplicity of perforations therein defining the perimeter of a predetermined closed splicing area having at least one rectilinear side extending transversely to said tube and having a length smaller than said width;

severing means at a stacking station for transversely cutting said tube along said side;

welding means for heat-sealing said tube to form a seam parallel to said side;

clamping means juxtaposed to said severing means for holding said tube during a cutting operation of said severing means;

a needle bar extending transversely to said path at said stacking station, said bar including needle means at least partially for aligning bags in a stack at said stacking station and heating means for thermally bonding splicing areas of adjacent bags in said stack; and conveyor means for transporting said tube along said path to said stacking station, said heating means including at least one heatable mandrel extending perpendicularly to said tube and to said path, said needle means including at least two needles disposed parallel to said mandrel and substantially in a line therewith extending transversely to said tube, said bar being provided with at least one threaded bore for the reception and mounting of a heater plug for thermally energizing said mandrel.

2. The apparatus defined in claim 1 wherein a plurality of bores are provided in said bar, each bore being flanked by a respective pair of needles.

3. The apparatus defined in claim 1 or claim 2 wherein said conveyor means includes a pair of rollers upstream of said stacking station and said punch means is disposed along said path upstream of said rollers.

4. The apparatus defined in claim 7 wherein said punch means includes a perforator shiftably mounted on a carriage for position adjustment parallel to said path.

5. The apparatus defined in claim 1 or claim 2 wherein said clamping means includes an upper clamping bar and a lower clamping bar extending parallel thereto and perpendicularly to said path, said needle bar being disposed below said lower clamping bar, said clamping bars being provided with apertures aligned with said needles and said mandrel, whereby same traverse said lower clamping bar and at least a portion of said upper clamping bar to pierce said tube for aligning and thermally bonding same.

6. The apparatus defined in claim 5 wherein said welding means includes an upper and a lower vertically reciprocatable heating bar, said clamping means further includes an upper and lower vertically reciprocatable clamping bar and said severing means includes a vertically reciprocatable cutting blade.

* * * * *